United States Patent [19]

Jacobsson

[11] Patent Number: 4,754,616

[45] Date of Patent: Jul. 5, 1988

[54] YARN SUPPLY SYSTEM

[75] Inventor: Kurt A. G. Jacobsson, Ulricehamn, Sweden

[73] Assignee: Aktiebolaget IRO, Ulricehamn, Sweden

[21] Appl. No.: 60,711

[22] PCT Filed: Sep. 4, 1986

[86] PCT No.: PCT/EP86/00511

§ 371 Date: May 4, 1987

§ 102(e) Date: May 4, 1987

[87] PCT Pub. No.: WO87/01399

PCT Pub. Date: Mar. 12, 1987

[30] Foreign Application Priority Data

Sep. 4, 1985 [SE] Sweden ..... 8504130

[51] Int. Cl.[4] ..... D04B 15/44

[52] U.S. Cl. ..... 66/146; 66/163; 66/158

[58] Field of Search ..... 66/146, 163, 132 R, 66/158

[56] References Cited

U.S. PATENT DOCUMENTS

| | | | |
|---|---|---|---|
| 3,807,199 | 4/1974 | Rosen | 66/163 |
| 4,259,851 | 4/1981 | Jacobsson | 66/163 X |
| 4,628,710 | 12/1986 | Jacobsson | 66/163 X |

*Primary Examiner*—Ronald Feldbaum

*Attorney, Agent, or Firm*—Flynn, Thiel, Boutell & Tanis

[57] ABSTRACT

The take up means (5) is inhibited in response to a predetermined operating conditions of the flat knitting machine.

6 Claims, 3 Drawing Sheets

YARN SUPPLY SYSTEM

FIELD OF THE INVENTION

The present invention relates to a yarn supply system for a flat knitting machine.

BACKGROUND OF THE INVENTION

A prior art yarn supply system for a flat knitting machine comprises a yarn spool, a yarn tensioning unit comprising a yarn storing and feeding device to which a yarn can be supplied from the yarn spool for an intermediate store of the yarn on a storage drum of the feeding device. The yarn can be actually withdrawn from said storage drum through a yarn tensioning device arranged at the withdrawal end of the storage drum. The yarn withdrawn from the storage drum of the yarn feeding device is fed to a yarn take-up arm which is pivotally journalled under a spring-load and which is adapted for intermittently taking up an excess of yarn in case the yarn tension drops below a predetermined yarn tension value.

A flat knitting machine comprises a stationary needle bed and a carriage which can be reciprocated with respect to said needle bed for operating the needles and for moving a thread feeder arranged at the carriage along the needle bed so as to supply the yarn to the respective operated needles. The movement of the carriage of a flat knitting machine does not terminate at the respective ends of the needle bed of the knitting machine, but there is a so-called over-movement of the carriage with respect to the needle bed of the flat knitting machine. This over-movement of the carriage at both end positions of its horizontal movement over the needle bed is carried out when changing the thread feeder arranged at the carriage during the colour change as well when only changing the direction of the movement of the carriage when further working by means of the same thread feeder without changing the colour. The yarn consumption of the knitting machine during the normal operation when the carriage is within the normal working area, i.e., between the respective ends of the needle bed, is essentially constant. The yarn consumption drops at the respective remote ends, i.e., during the over-movement of the carriage. Hence, a surplus of yarn is to be taken back in a controlled manner at the respective remote ends of the fabric so as to make the edges of the knitted fabric look satisfactory.

In the prior art yarn supply system, the spring-loaded arm intermittently takes up the surplus or excess of yarn by a pivot movement.

The spring-loaded arm has the tendency to cause vibrations and oscillations in the yarn tension which in turn negatively affects the continuity in building up the respective stitches and thus results in an unsufficient knitting quality.

In view of this state of art, the present invention s based on the technical task of how to further develop a yarn supply system for a flat knitting machine adapted for manufacturing a high quality knitted fabric having an essentially constant stitch size.

This technical task is solved by a yarn supply system in accordance with the prior art portion of claim 1 having the features indicated in the characterising portion thereof.

In accordance with the present invention, the operation of the yarn take-up means is inhibited in response to predetermined operating conditions of the flat knitting machine. These operating conditions may be the relative position of the carriage with respect to the needle bed and/or the actual movement of the yarn withdrawn from the yarn tensioning unit.

Preferably, the operation of the yarn take-up means is inhibited during the so-called "normal" operation of the flat knitting machine, i.e., during the movement of the carriage between the respective ends of the needle bed. Hence, the occurrence of any oscillations of the yarn take-up means during the normal knitting operation is prevented. In other words, slight oscillations may only occur at the very short operating time during the over-movement of the carriage. As a result therefrom, the knitted fabric manufactured by a flat knitting machine having a yarn supply system in accordance with the present invention has a very constant stitch size and thus a high quality.

Advantageous embodiments in accordance with the present invention are defined in the subclaims.

BRIEF DESCRIPTION OF THE DRAWINGS

Hereinafter, a preferred embodiment in accordance with the present invention will be described with reference to the attached drawings, in which.

DETAILED DESCRIPTION

Figure 1:
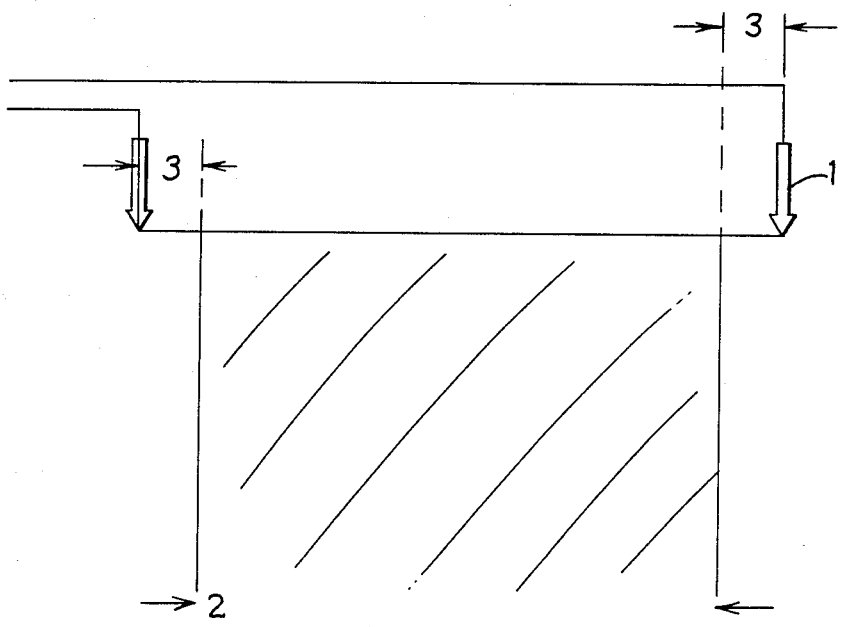
FIG. 1 shows a schematic representation of a normal working area and an area of over-movement of a carriage of a flat knitting machine.

FIG. 1 shows a sketch for explaining the respective working areas of a flat knitting machine known per se in the art.

As described above, a flat knitting machine (not shown) includes a carriage (not shown) which is adapted for a reciprocating movement with respect to a needle bed of the knitting machine. A thread feeder 1 mounted to the carriage is moved along the needle bed. The area between the respective ends of the needle bed is the so-called "normal" working area which is indicated by the reference number 2 in FIG. 1. For reasons described above, the thread feeder 1 must carry out an over-movement beyond the normal working area 2 at the respective ends of the fabric to be knitted. The area of over-movement at both ends is designated with the reference number 3 in FIG. 1.

Figure 2:
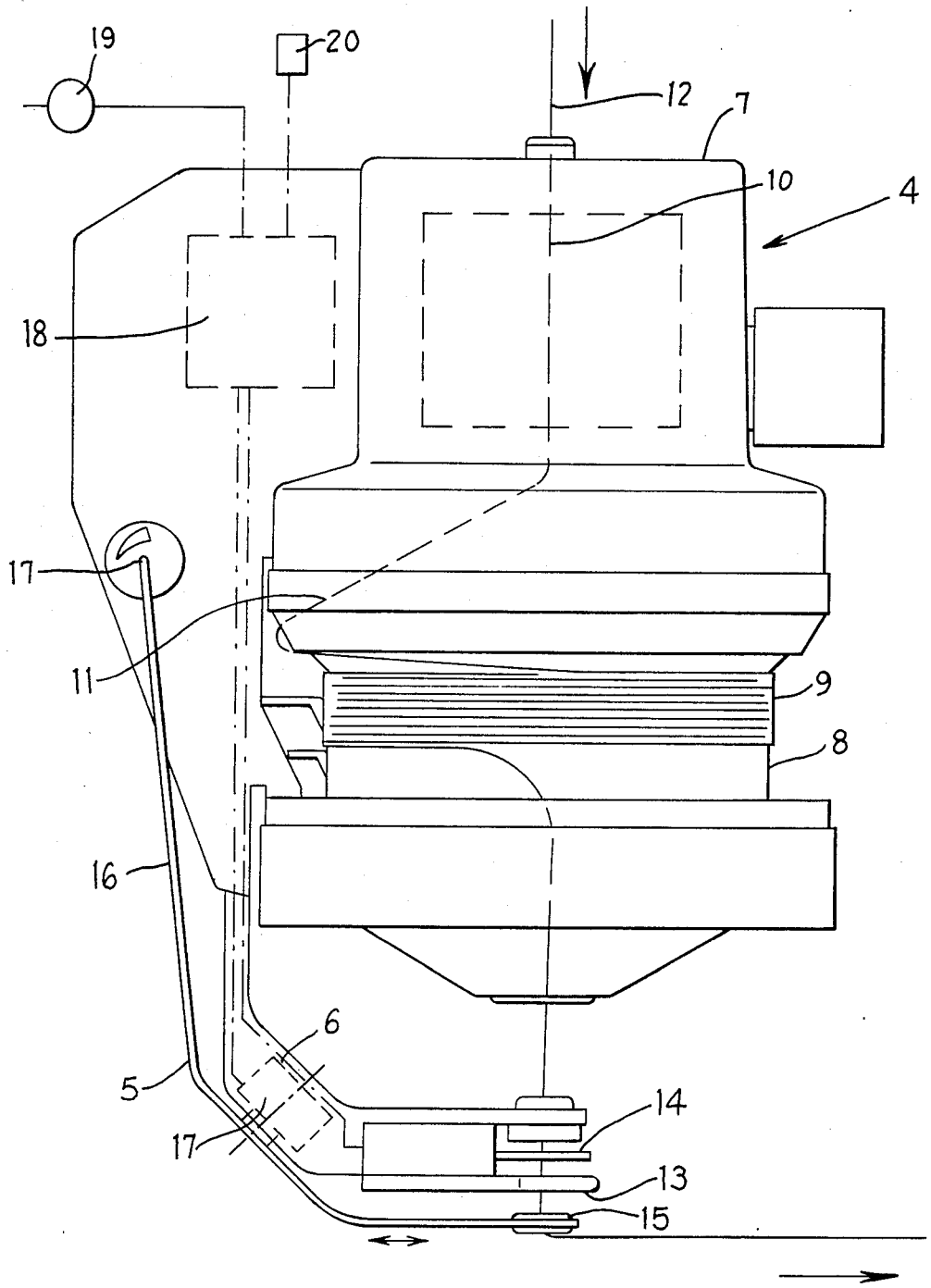
FIG. 2 shows a yarn supply system for a flat knitting machine in accordance with the present invention.

A yarn supply system for the flat knitting machine in accordance with the preferred embodiment shown in FIG. 2 comprises a yarn spool (not shown), a yarn tensioning unit 4, a yarn inhibiting means 6 for inhibiting the operation of the yarn take-up means 5.

The yarn tensioning unit 4 comprises a yarn storing and feeding device 7. For the purposes of the disclosure of said device, reference is made to the applicant's prepublished European Patent Application No. 84 108 138.3.

The yarn storing and feeding device has a storage drum 8, onto which an intermediate yarn store 9 can be wound. To be more specific, the storing and feeding device 7 includes a hollow shaft 10 extending to a rotating winding-on tube 11 for winding the yarn 12 on the storage drum 8 so as to form an intermediate yarn store 9. With regard to details of the design and mode of operation of yarn feeding devices, reference is made to the above-indicated European Patent Application.

The yarn can be withdrawn from the storage drum 8 in its axial direction through a yarn tensioning and clamping device 13 arranged at the withdrawal end of the storage drum. The yarn tensioning and clamping device 13 establishes a predetermined first yarn tension in the yarn when withdrawing the yarn from the storage drum. Instead of the yarn tensioning and clamping device, any yarn brake adapted for creating a predetermined tension in the yarn when drawing the yarn through it can be used.

The yarn withdrawn from the storage drum 8 is fed through a yarn movement sensor 14 arranged in the path of the yarn between the storage drum 8 and the yarn tensioning and clamping device 13. The yarn having passed the yarn tensioning and clamping device 13 is fed via a guiding eyelet 15 of the yarn take-up means 5 to the thread feeder 1 (FIG. 1) arranged at the carriage of the flat knitting machine.

The yarn take-up means 5 is formed by a pivotable yarn take-up arm known per se in the art, which is pre-biased under a spring load such that its guiding eyelet 15 tends to draw the yarn away from the yarn tensioning and clamping device 13. The pivotable yarn take-up arm 16 is journalled at a bearing at the housing of the storing and feeding device 7.

The inhibiting means for inhibiting the operation of the yarn take-up means 5 in response to predetermined operating conditions of the flat knitting machine comprises an electric holding magnet 17 which is electrically connected to a control unit 18 and which holds the pivotable yarn take-up arm 16 in the position shown at FIG. 2 when the holding magnet 17 is supplied with an inhibiting signal generated by the control unit 18.

The control unit 18 may comprise a micro-computer or micro-processor which is adaptively programmed for generating the inhibiting signal to be fed to the holding magnet 17 under predetermined operating conditions of the flat knitting machine, which are derived from sensor signals generated by said movement sensor 14 and by a position sensor 19. The signal generated by the position sensor 19 indicates whether or not the carriage of the flat knitting machine is in the normal working area 2 or in the area 3 of over-movement. The control unit 18 is also connected to a so-called stop-motion relay 20 for actuating same in case of erroneous operating conditions indicating that some fault has occurred in the feeding of yarn to the flat knitting machine, like a yarn breakage, a clogged thread feeder 1 and so on.

Figure 3:
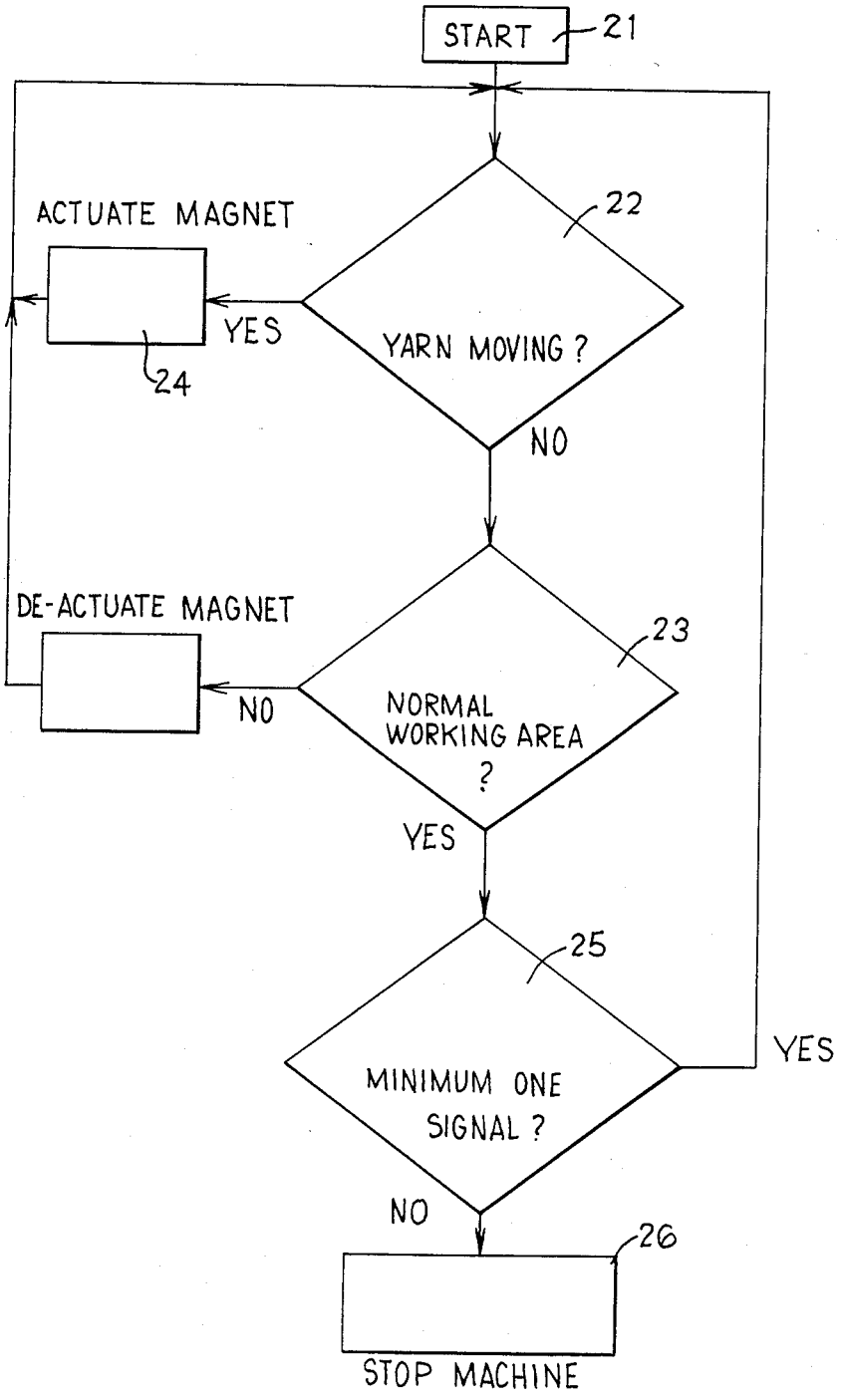
FIG. 3 shows a flow diagram of a control programme of a control unit used for controlling the yarn supply system in accordance with FIG. 2.

With reference to FIG. 3 an explanation of the flow diagram of the programme stored in the micro-processor 18 will be given.

Box number 21 indicates the start of the programme routine.

At the programme step number 22, the control unit 18 checks whether the sensor signal received from the yarn movement sensor 14 indicates whether or not the yarn moves at a predetermined speed. As long as the yarn is withdrawn from the storage drum 8 at a certain speed, the control unit will go to programme step number 24 for maintaining the holding magnet 17 in its actuated condition, i.e., for continuously feeding the inhibiting signal to the holding magnet 17. Thereinafter, the control unit goes back to programme step number 22.

In case the control unit 18 determines at programme step number 22 that the yarn is not moving or not moving at the predetermined minimum speed, it goes to programme step number 23. At programme step number 23, the control unit 18 checks the output signal generated by the position sensor 19. In case the output signal of the position sensor 19 indicates that the carriage is not in the normal working area 2, but in one of the areas 3 of over-movement, the inhibiting signal is turned off for deactuating the holding magnet 17 and thus enabling the operation of the yarn take-up means 5. After having de-actuated the holding magnet 17, the control unit 18 goes back to programme step number 22. In case the control unit determines at programme step number 23 that the carriage is within the normal working area, the control unit goes to programme step number 25. Programme step number 25 is an optional measure for a multi-colour flat knitting machine having a plurality of thread feeders 1 and a plurality of yarn movement sensors 14, each sensor being associated to one yarn colour. At programme step number 25, the control unit detects whether at least one movement sensor detects the movement of a yarn. If so, the control unit goes back to programme step number 22. Otherwise, it goes to programme step number 26, since the detection of no yarn movement in the normal working area of the knitting machine indicates that some kind of fault has occurred in the feeding of yarn, for example a yarn breakage. Hence, the control unit actuates the stop-motion-relay so as to immediately stop the flat knitting machine.

The present invention is not limited to the above-described preferred embodiment.

For example, the yarn tensioning unit located between the yarn spool and the yarn take-up means does not necessarily comprise a yarn feeding and storing device, although a yarn feeding and storing device with a subsequent yarn tensioning device located at the withdrawal end thereof is advantageous for obtaining a continuous yarn tension. For example, the yarn tensioning unit 4 can be replaced by a simple yarn brake, like a yarn disc brake located between the yarn spool and the yarn take-up means.

Furthermore, the yarn take-up means does not necessarily comprise a pivotable yarn take-up arm, since the yarn take-up means can be implemented by any unit adapted for taking yarn in case the yarn tension drops below a minimum value.

Moreover, the inhibiting means does not necessarily have to comprise a holding magnet but could be carried out, for example by means for releasing the spring-load of the yarn take-up means so as to inhibit the operation thereof. In addition, the inhibiting means may have the form of an electric pre-biasing device for replacing the mechanical spring used for pre-biasing the pivotable arm of the preferred embodiment.

Although the tensioning unit of the preferred embodiment is a storing and feeding device having a tensioning and clamping device it can be any kind of a yarn braking unit like a brush ring or a combination of a clamping device and a braking unit in the form of a brush ring. The clamping device can also be a so-called "trapper unit" having a re-shaped clamping opening for trapping the yarn when the take-up means is in its actuated position.

Alternatively, the braking device can have the form of the ball-brake disclosed in DE-OS No. 33 16 078.

What is claimed is:

1. Yarn supply system for a flat knitting machine, comprising:

a yarn spool;

a yarn tensioning unit (4) to which a yarn can be supplied from the yarn spool and from which the yarn can be withdrawn under an essentially constant yarn tension corresponding to a first tension value;

a yarn take-up means (5) adapted for taking-up an excess of yarn in case the actual yarn tension drops below a predetermined second tension value, said second tension value being smaller than said first tension value, characterised by means (6) for inhibiting the operation of said yarn take-up means (5) in response to predetermined operating conditions of said flat knitting machine.

2. Yarn supply system as claimed in claim 1, characterised in that said inhibiting means (6) is responsive to a relative position of a carriage of the flat knitting machine with respect to the needle bed thereof.

3. Yarn supply system as claimed in claim 2, characterised in that said inhibiting means (6) includes a sensor (19) generating an inhibiting signal for inhibiting the operation of said yarn take-up means (6) when said carriage is within the normal working area of said needle bed.

4. Yarn supply system as claimed claim 1 characterised in that said yarn tensioning unit (4) comprises a yarn feeding device (7) having a yarn storage drum (8) onto which an intermediate store of yarn can be wound, said yarn feeding device (7) including a tensioning device (13) arranged at the withdrawal end of said storage drum (8), and said take-up means (5) has the form of a pivotable yarn take-up arm (16) arranged to take up an excess of yarn when the actual yarn tension drops below said second tension value.

5. Yarn supply system as claimed claim 1 characterised in that said inhibiting means (6) comprises:

a position sensor (19) for detecting the relative position of a carriage of the flat knitting machine with respect to the needle bed thereof;

a yarn movement sensor (14) for detecting the moving of the yarn withdrawn from said yarn tensioning unit (4), and a control unit (18) connected to both sensors (14, 19), said control unit (18) being arranged for generating an inhibiting signal in response to said predetermined operating conditions, which conditions are determined on the basis of the output signals of these sensors (14, 19).

6. Yarn supply system as claimed in claim 5, characterised in that said control unit (18) generates said inhibiting signal when the yarn movement sensor (14) detects the moving of the yarn, and said control unit (18) enables the operation of the yarn take-up means (5) by terminating said inhibiting signal if the yarn movement sensor (14) detects the termination of the yarn movement or a reduction of the speed of the yarn movement and if the position sensor (19) detects that the carriage is outside of said normal working area (2) of said flat knitting machine.

* * * * *